US007984618B2

(12) United States Patent
Kudo

(10) Patent No.: US 7,984,618 B2
(45) Date of Patent: Jul. 26, 2011

(54) COOLING APPARATUS AND VACUUM COOLING APPARATUS

(75) Inventor: Kenji Kudo, Minamitsuru-gun (JP)

(73) Assignee: Canon Anelva Corporation, Kawasaki-shi (JP)

( * ) Notice: Subject to any disclaimer, the term of this patent is extended or adjusted under 35 U.S.C. 154(b) by 446 days.

(21) Appl. No.: 12/339,760

(22) Filed: Dec. 19, 2008

(65) Prior Publication Data

US 2009/0165465 A1 Jul. 2, 2009

(30) Foreign Application Priority Data

Dec. 27, 2007 (JP) ..... 2007-336763

(51) Int. Cl.
*F25D 23/12* (2006.01)
*G01R 31/00* (2006.01)
*G01R 31/10* (2006.01)

(52) U.S. Cl. ..... 62/259.2; 324/750.03; 324/750.09

(58) Field of Classification Search ..... 62/3.1, 62/259.1, 259.2; 324/750.03, 750.09, 750.28
See application file for complete search history.

(56) References Cited

U.S. PATENT DOCUMENTS

2002/0008534 A1* 1/2002 Yamazaki ..... 324/760

FOREIGN PATENT DOCUMENTS

| | | |
|---|---|---|
| JP | 5-066095 | 3/1993 |
| JP | 7-006541 | 1/1995 |
| JP | 9-050910 | 2/1997 |
| JP | 11-200039 | 7/1999 |
| JP | 2000-146342 | 5/2000 |

OTHER PUBLICATIONS

English translation of Japanese Office Action dated Nov. 24, 2009, in corresponding Japanese Patent Appln. No. 2007-336763.
Japanese Office Action dated Nov. 24, 2009, in related corresponding Japanese Patent Appln. No. 2007-336763.

* cited by examiner

*Primary Examiner* — Chen Wen Jiang
(74) *Attorney, Agent, or Firm* — Fitzpatrick, Cella, Harper & Scinto

(57) ABSTRACT

A cooling apparatus includes a refrigerating machine including a cooling portion fixed to a support body and cools a cooling target through the cooling portion. The cooling target and the cooling portion are connected by a structure including an extendable pipe filled with a fluidized refrigerant. A first magnetic body fixed to a side of the support body and a second magnetic body fixed to a side of the pipe are arranged around the pipe. The first magnetic body and the second magnetic body are maintained in non-contact with each other.

6 Claims, 1 Drawing Sheet

FIGURE
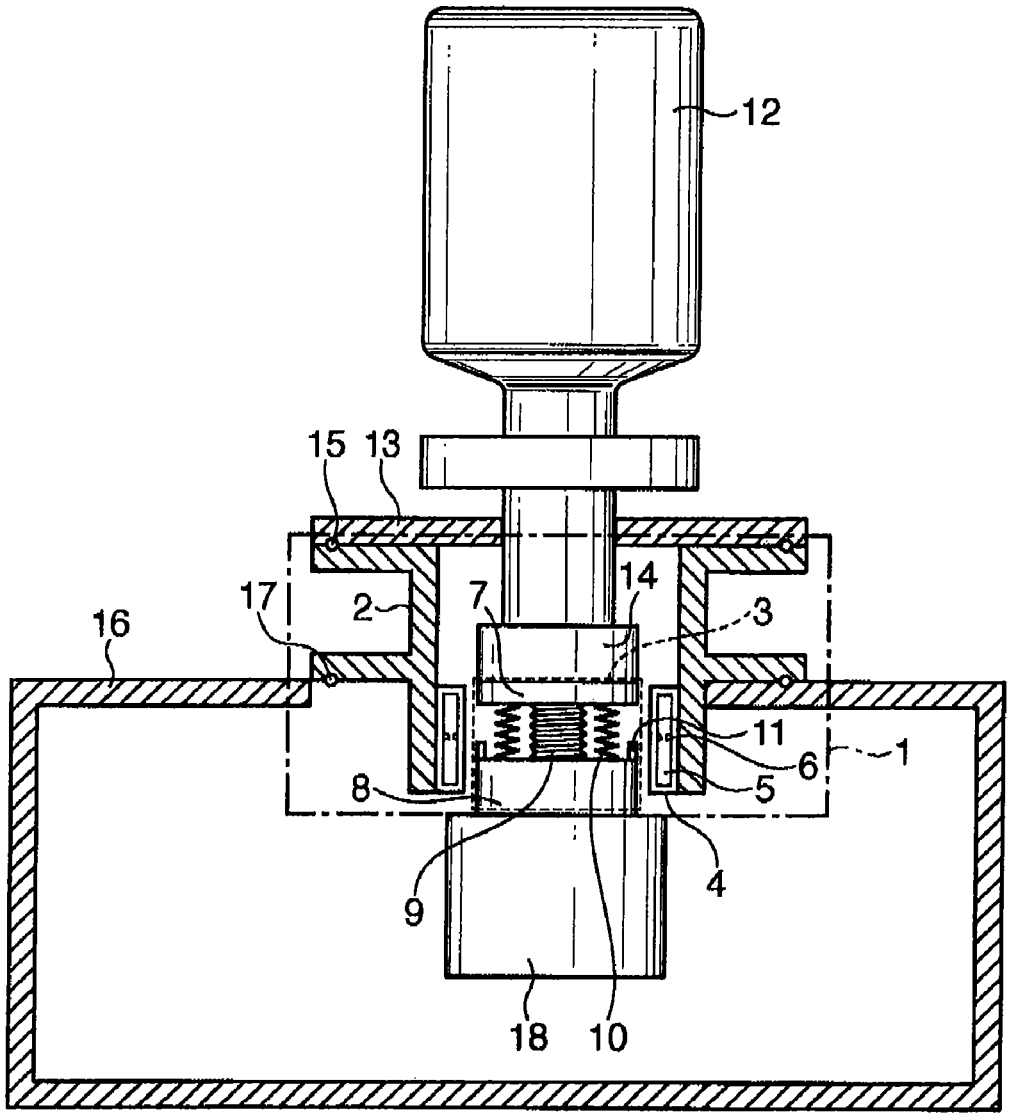

COOLING APPARATUS AND VACUUM COOLING APPARATUS

BACKGROUND OF THE INVENTION

1. Field of the Invention

The present invention relates to a cooling apparatus and, more particularly, to a cooling apparatus which cools a cooling target such as a substrate to be processed in a vacuum container, or a laser oscillator.

2. Description of the Related Art

To cool a cooling target such as a substrate to be processed in a vacuum container, or a laser oscillator using a refrigerating machine, usually, the cooling target is directly brought into tight contact with the cooling portion (made of a metal having high thermal conductivity) of a refrigerating machine.

When the cooling target is an object that should not be vibrated, the refrigerating machine is installed at a location away from the cooling target and a liquid refrigerant cooled by the refrigerating machine is supplied under pressure into a heat-insulated pipe using the power of a circulating pump or the like, thus cooling the cooling target.

This can cool the cooling target indirectly while reducing vibration from the refrigerating machine.

Japanese Patent Laid-Open No. 2000-146342 discloses a refrigerating apparatus in which a vibration-proofing means is arranged between a refrigerating machine main body and a cooling target portion in contact with the refrigerating machine main body, and the vibration-proofing means comprises a vibration-proofing rubber member and a plurality of spherical members.

As described above, in an atmosphere or vacuum, when cooling the cooling target by fixing it to the refrigerating machine cooling portion, vibration generated by operating of the refrigerating machine may undesirably be transmitted to the cooling target.

Therefore, the conventional refrigerating apparatus cannot be used for a cooling target that should not be vibrated.

When installing the refrigerating machine main body at a location away from the cooling target and cooling the cooling target indirectly with the refrigerant which is supplied under pressure using the power of a circulating pump or the like, the installation distance between the refrigerating machine main body and the cooling target must be large. Therefore, it is difficult to arrange the apparatus particularly in a vacuum container.

Hence, a heat-insulated long pipe is set in the atmosphere, and the refrigerant is supplied under pressure through the pipe. Even with the heat-insulated pipe, however, external heat largely influences the pipe, and the refrigerant temperature rises during supply under pressure, thus decreasing the heat transfer efficiency.

To forcibly supply the refrigerant under pressure, power from a circulating pump or the like is required. Heat generated by the motor or the like of the circulating pump may increase the refrigerant temperature.

With the technique described in Japanese Patent Laid-Open No. 2000-146342, when the cooling target is set in direct contact with the vacuum container to cool it integrally with the vacuum container, vibration may undesirably be transmitted from the refrigerating machine main body to the cooling target.

SUMMARY OF THE INVENTION

It is therefore an object of the present invention to enable, in a cooling apparatus, reduction of vibration from a refrigerating machine to various types of cooling targets while efficiently cooling the cooling targets, particularly in a vacuum.

According to one aspect of the present invention, there is provided a cooling apparatus which comprises a refrigerating machine including a cooling portion fixed to a support body and cools a cooling target through the cooling portion, wherein the cooling target and the cooling portion are connected by a structure comprising an extendable pipe filled with a fluidized refrigerant, and a first magnetic body fixed to a side of the support body and a second magnetic body fixed to a side of the pipe are arranged around the pipe, and the first magnetic body and the second magnetic body are maintained in noncontact with each other.

According to another aspect of the present invention, there is provided a vacuum cooling apparatus which comprises a refrigerating machine including a cooling portion fixed to a vacuum container serving as a support body and cools a cooling target arranged in the vacuum container through the cooling portion, wherein the cooling target and the cooling portion are connected by a structure comprising an extendable pipe filled with a fluidized refrigerant, and a first magnetic body fixed to a side of the vacuum container and a second magnetic body fixed to a side of the pipe are arranged around the pipe, and the first magnetic body and the second magnetic body are maintained in noncontact with each other.

According to the present invention, vibration from a refrigerating machine can be reduced particularly in a vacuum as well, while efficiently cooling a cooling target using the refrigerating machine.

Further features of the present invention will become apparent from the following description of exemplary embodiments with reference to the attached drawings.

BRIEF DESCRIPTION OF THE DRAWINGS

The FIGURE is a sectional view showing the arrangement of a cooling apparatus according to one embodiment of the present invention.

DESCRIPTION OF THE EMBODIMENT

The most preferred embodiment to practice the present invention will be described hereinafter with reference to the accompanying drawing.

The FIGURE is a sectional view showing the arrangement of a cooling apparatus according to one embodiment of the present invention.

Referring to the FIGURE, a portion surrounded by an alternate long and a short dashed line indicates a main part 1 of the cooling apparatus according to this embodiment.

As shown in the FIGURE, the cooling apparatus according to this embodiment is, for example, a vacuum cooling apparatus which includes a refrigerating machine to form a cooling portion by repeating compression and expansion of gas and cools a cooling target, arranged in a vacuum container serving as a pressure-reducible support body, through the cooling portion. Note that the support body is not limited to a vacuum container as far as the cooling apparatus has a mechanical strength that can support the refrigerating machine.

More specifically, a refrigerating machine main body 12 having a refrigerating machine cooling portion 14 is fixed to a vacuum vessel-side member including a refrigerating machine vacuum flange 13, vacuum pipe portion 2, and vacuum container 16 which are sealed by an O-ring A 15 and O-ring B 17.

A heat transfer plate A 7 and heat transfer plate B 8 in contact with the refrigerating machine cooling portion 14 seal a refrigerant in an extendable pipe 9 to form one structure. A cooling target 18 is hung from the refrigerating machine main body 12 through this structure.

A jig such as a screw is used to fix the heat transfer plate B 8 to the cooling target 18. As shown in the FIGURE, for example, the cooling target 18 may be held by the refrigerating machine cooling portion 14 through a spring 10 serving as an elastic body.

In the FIGURE, a cylindrical container 4 which seals a magnetic fluid 5 serving as the first magnetic body is fixed to the vacuum container serving as the support body. The cylindrical container 4 may have an orifice 6 to receive the resistance of the flow of the magnetic fluid 5.

A second magnetic body 11 is fixed to the pipe 9 side.

In particular, the main part 1 surrounded by the alternate long and a short dashed line comprises the vacuum pipe portion 2, a heat transfer portion 3, and the cylindrical container 4 which seals the magnetic fluid 5 serving as the first magnetic body.

The respective components will be described hereinafter in detail.

The heat transfer portion 3 surrounded by a broken line includes the following components, that is, the metal heat transfer plate A 7 brought into tight contact with the refrigerating machine cooling portion 14 with a screw or the like and having a high heat transfer property, the metal heat transfer plate B 8 brought into tight contact with the cooling target 18 with a screw or the like and having a high heat transfer property, the pipe 9, the spring 10, and the second magnetic body 11.

The fluidized gas-liquid phase-mixed refrigerant fills the pipe 9. The extendable pipe 9 is arranged to be located at the center of the hollow portion of the vacuum pipe portion 2.

The cylindrical container 4 which seals the magnetic fluid 5 serving as the first magnetic body, and the second magnetic body 11 are arranged hot to be in contact with each other considering the intensities and equilibrium of their magnetic forces, and accordingly will not receive vibration from the vacuum pipe portion 2.

More specifically, the cylindrical container 4 has a hollow portion, is fixed to the inner wall of the vacuum pipe portion 2, and is arranged to cover the outer surface of the pipe 9. The magnetic fluid 5 is sealed in the cylindrical container 4 as the first magnetic body. The inner wall of the cylindrical container 4 may be provided with the orifice 6 which receives the resistance from the flow of the magnetic fluid 5.

The second magnetic body 11 such as a permanent magnet is arranged in the space between the outer surface of the pipe 9 and the inner wall of the cylindrical container 4, and is provided considering the symmetry and distance between the pipe 9 and cylindrical container 4 to maintain a predetermined gap with respect to the inner wall of the cylindrical container 4 serving as the first magnetic body.

The refrigerating machine main body 12 is connected to the vacuum pipe portion 2 through the O-ring A 15 at the refrigerating machine vacuum flange 13. Similarly, the vacuum pipe portion 2 and vacuum container 16 are connected to each other through the O-ring B 17. Then, a vacuum evacuation mechanism (not shown) vacuum-evacuates the interior of the vacuum pipe portion 2 and that of the vacuum container 16 to set them in the vacuum state.

The heat transfer plate A 7 is brought into tight contact with the refrigerating machine cooling portion 14 using a screw or the like. The pipe 9 and the heat transfer plate B 8 connected to the refrigerating machine cooling portion 14 with the spring 10 support the cooling target 18 using a screw or the like.

Then, the cooling target 18 is cooled through only the heat transfer plate A 7, the gas-liquid phase-mixed refrigerant that fills the pipe 9, and the heat transfer plate B 8.

Furthermore, the heat transfer plate A 7 in tight contact with the refrigerating machine cooling portion 14 is positioned above the heat transfer plate B 8 in tight contact with the cooling target 18.

Then, the refrigerant in the gas phase state residing at the upper portion of the interior of the pipe 9 close to the heat transfer plate A 7 is cooled and liquefied and moves to the lower portion of the interior of the pipe 9. Hence, the refrigerant in the liquid phase state at the lower portion in the pipe 9 also causes natural convection due to the difference in specific weight caused by a temperature change.

As a result, that portion of the refrigerant which is cooled to the lowest temperature always gathers in the vicinity of the lower heat transfer plate B 8, thus obtaining a high heat transfer effect.

As all the refrigerant is arranged under the vacuum condition, the external thermal influence can be minimized.

The pipe 9 which connects the refrigerating machine cooling portion 14 to the cooling target 18 through the heat transfer plate A 7 and heat transfer plate B 8 is formed of a flexible metal pipe having a bellows structure and can reduce the vibration transmitted directly from the refrigerating machine.

As the pipe 9 can move freely, however, the cooling target 18 is not fixed in position but vibrates freely.

In view of this, the heat transfer plate A 7 is connected to the heat transfer plate B 8 using the spring 10 to arbitrary determine the position of the cooling target 18 in the vertical direction.

Also, the magnetic force between the second magnetic body 11 arranged on the edge of the heat transfer plate B 8 and the magnetic fluid 5 in the cylindrical container 4 serving as the first magnetic body can suppress displacement of the cooling target 18 in the horizontal direction.

Furthermore, when the cooling target 18 and heat transfer plate B 8 displace, the magnetic fluid 5 arranged nearby and serving as the first magnetic body moves in accordance with the movement of the second magnetic body 11 by the operation of the second magnetic body 11 arranged on the edge of the heat transfer plate B 8.

When the magnetic fluid 5 moves in the cylindrical container 4, the resistance generated by the orifice 6 reacts against the second magnetic body 11 to attenuate the displacement of the heat transfer plate B 8 and cooling target 18.

The magnetic fluid 5 in the cylindrical container 4 which serves as the first magnetic body that controls the position of the cooling target 18 does not come into contact with the cooling target 18, Thus, the cooling efficiency can be improved while reducing the thermal load on the refrigerating machine.

Examples of the refrigerant to fill the pipe 9 include water when the temperature is in the range of room temperature to approximately 0° C., carbon dioxide when the temperature is up to approximately −50° C., and butane gas or the like when the temperature is up to approximately −100° C.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-336763, filed Dec. 27, 2007, which is hereby incorporated by reference herein in its entirety.

What is claimed is:

1. A cooling apparatus which comprises a refrigerating machine including a cooling portion fixed to a support body and cools a cooling target through said cooling portion, wherein the cooling target and said cooling portion are connected by a structure comprising an extendable pipe filled with a fluidized refrigerant, and a first magnetic body fixed to a side of said support body and a second magnetic body fixed to a side of said pipe are arranged around said pipe, and said first magnetic body and said second magnetic body are maintained in noncontact with each other.

2. The apparatus according to claim 1, wherein said pipe comprises a metal pipe including a bellows structure.

3. The apparatus according to claim 1, wherein said first magnetic body comprises a magnetic fluid.

4. A vacuum cooling apparatus which comprises a refrigerating machine including a cooling portion fixed to a vacuum container serving as a support body and cools a cooling target arranged in said vacuum container through said cooling portion, wherein the cooling target and said cooling portion are connected by a structure comprising an extendable pipe filled with a fluidized refrigerant, and a first magnetic body fixed to a side of said vacuum container and a second magnetic body fixed to a side of said pipe are arranged around said pipe, and said first magnetic body and said second magnetic body are maintained in noncontact with each other.

5. The apparatus according to claim 4, wherein said pipe comprises a metal pipe including a bellows structure.

6. The apparatus according to claim 4, wherein said first magnetic body comprises a magnetic fluid.

* * * * *